US006749230B1

(12) United States Patent
Casagrande

(10) Patent No.: US 6,749,230 B1
(45) Date of Patent: Jun. 15, 2004

(54) BUSINESS FORM WITH IMAGING COMPATIBLE PUNCH-OUT CARD AND METHOD

(76) Inventor: Charles L. Casagrande, Precision Coated Products, Ltd., Gillingham Business Park, Unit 4, Saracen Close, Gillingham, Kent ME8 0QN (GB)

( * ) Notice: Subject to any disclaimer, the term of this patent is extended or adjusted under 35 U.S.C. 154(b) by 0 days.

(21) Appl. No.: 09/574,591

(22) Filed: May 18, 2000

(51) Int. Cl.[7] ..... B42D 15/00

(52) U.S. Cl. ..... 283/61; 156/275.5; 229/69; 229/92; 283/81; 283/101; 283/105; 428/40.1; 428/43; 428/95; 462/25

(58) Field of Search ..... 283/61, 81, 94, 283/98, 101, 103, 105, 108; 428/42.2, 40.1, 41.7, 41.8, 43, 95; 462/25; 229/69, 92, 92.1, 92.3, 92.5; 156/275.5

(56) References Cited

U.S. PATENT DOCUMENTS

| | | | | | |
|---|---|---|---|---|---|
| 3,792,542 | A | | 2/1974 | Cohan | 40/158 B |
| 3,854,229 | A | | 12/1974 | Morgan | 40/2 |
| 3,914,483 | A | | 10/1975 | Stipek, Jr. | |
| 4,032,679 | A | * | 6/1977 | Aoyagi | 428/42.3 |
| 4,204,706 | A | | 5/1980 | Blum et al. | |
| 4,379,573 | A | | 4/1983 | Lomeli et al. | 428/42 |
| 4,854,610 | A | | 8/1989 | Kwiatek | 282/11.5 A |
| 4,861,636 | A | | 8/1989 | Barnette | 428/41 |
| 4,890,862 | A | | 1/1990 | Buchholz | 283/62 |
| 4,910,058 | A | | 3/1990 | Jameson | 428/42 |
| 5,098,759 | A | | 3/1992 | Felix | 428/42 |
| 5,131,686 | A | | 7/1992 | Carlson | 283/75 |
| 5,219,183 | A | * | 6/1993 | McKillip | 283/101 |
| 5,249,828 | A | | 10/1993 | Axelrod | 283/61 |
| 5,279,875 | A | | 1/1994 | Juszak et al. | 428/42 |
| 5,281,799 | A | | 1/1994 | McIntire et al. | 235/380 |
| 5,320,387 | A | | 6/1994 | Carlson | 283/75 |
| 5,324,153 | A | | 6/1994 | Chess | 412/9 |
| 5,403,236 | A | | 4/1995 | Greig | 462/6 |
| 5,410,136 | A | | 4/1995 | McIntire et al. | 235/380 |
| 5,413,830 | A | | 5/1995 | Edwards | 428/40 |
| 5,427,416 | A | * | 6/1995 | Birch | 283/109 |
| 5,435,601 | A | | 7/1995 | Casari | 283/94 |
| 5,439,255 | A | | 8/1995 | McIntire et al. | 283/62 |
| 5,441,796 | A | | 8/1995 | Steidinger et al. | 428/195 |
| 5,462,488 | A | * | 10/1995 | McKillip | 462/26 |
| 5,466,013 | A | | 11/1995 | Garrison | 283/107 |
| 5,482,328 | A | | 1/1996 | Stewart | |
| 5,509,992 | A | | 4/1996 | Axelrod | 156/277 |
| 5,518,787 | A | * | 5/1996 | Konkol | 428/43 |
| 5,529,345 | A | * | 6/1996 | Kohls | 283/101 |
| 5,589,025 | A | * | 12/1996 | Garrison | 156/268 |
| 5,595,403 | A | * | 1/1997 | Garrison | 283/74 |
| 5,595,404 | A | * | 1/1997 | Skees | 283/116 |
| 5,601,313 | A | | 2/1997 | Konkol et al. | 283/81 |
| 5,660,896 | A | | 8/1997 | Normand et al. | |
| 5,662,976 | A | | 9/1997 | Popat et al. | |
| 5,704,650 | A | * | 1/1998 | Laurash et al. | 283/81 |
| 5,705,243 | A | * | 1/1998 | Mehta et al. | 428/40.1 |
| 5,776,586 | A | * | 7/1998 | Lipper | 428/195 |

(List continued on next page.)

FOREIGN PATENT DOCUMENTS

FR 2050035 * 3/1971

*Primary Examiner*—Monica S. Carter
(74) *Attorney, Agent, or Firm*—Thompson Coburn LLP

(57) ABSTRACT

A business form with laser compatible punch-out card and the methods of making the combination. The card is permanently adhered to a perforated backer sheet, the periphery of which extends beyond the card and is coated with adhesive for application to the bottom surface of a form containing a hole such that the card is disposed within the hole. The card and attached portion of the backer sheet can then be removed from the card-in-form combination by breaking the perforations. The card is die cut from card stock laminated to the backer layer and is prepared for application to the form by stripping a waste matrix of card material from the laminate through the use of patterned release material.

23 Claims, 7 Drawing Sheets

U.S. PATENT DOCUMENTS 5,782,497 A * 7/1998 Casagrande ..... 283/110
5,837,337 A * 11/1998 Schnitzer ..... 428/40.1
6,022,051 A * 2/2000 Casagrande ..... 283/107
6,053,535 A * 4/2000 Washburn et al. ..... 283/81
6,135,504 A * 10/2000 Teng ..... 283/101
6,142,532 A * 11/2000 Gluck ..... 283/75
6,217,078 B1 * 4/2001 Roth et al. ..... 283/101
6,328,340 B1 12/2001 Fischer
6,331,018 B1 * 12/2001 Roth et al. ..... 283/56
D453,529 S * 2/2002 Roth ..... D19/10
6,350,342 B1 2/2002 Steidinger et al.
6,364,364 B1 * 4/2002 Murphy ..... 283/101
6,403,191 B1 * 6/2002 Casagrande ..... 428/42.2
6,533,325 B1 * 3/2003 Steidinger ..... 283/105
6,569,280 B1 * 5/2003 Mehta et al. ..... 156/275.5
2002/0084649 A1 * 7/2002 Casagrande ..... 283/98

* cited by examiner

BUSINESS FORM WITH IMAGING COMPATIBLE PUNCH-OUT CARD AND METHOD

BACKGROUND OF THE INVENTION

I. Field of the Invention

The present invention relates generally to business forms with information cards therein and specifically to a business form containing an imagable punch-out information card and the methods of producing the card-in-form combination.

II. Related Art

Information cards are used in countless ways in our everyday lives to record and carry nearly any kind of data including advertisements, insurance records, identification data or even credit card information. In business, these cards are often associated with business forms or cover letters to explain to the user what the card is and how to use it. The proliferation of these information cards in business has created a need for a business form with a removable information card which is thin, durable, and easily and conveniently printable on both top and bottom surfaces with standard printing equipment. Such a product would allow a business to rapidly customize the form and the card at the same time with perfect accuracy and registration between the card and the form. Prior to the present invention, such a product did not exist since all prior products compromised at least one of these characteristics.

At present, most, if not all, commercially available business form and card combinations are produced in one of four ways. In the first and most simple way, the card is simply adhered to the surface of the form. While simple and easy to produce, this product can easily jam in printing machines due to the thickness of the card-on-form combination and the tendency of the card to predispense or peel away from the underlying adhesive when the form passes through tight radius turns such as those in modern printers. And of course, the card cannot be duplex printed once attached to the form since its bottom surface is covered by the form.

In the second type, a hole is cut in the form slightly larger than the card and the card is placed within the hole. Strips or patches of adhesive tape on the bottom surface of the business form cover at least part of the card to hold it in place within the hole. The bottom surface of the card is coated with or composed of a release material so that the card may be pulled away from the adhesive on the tape and removed from the form. This type of product, exemplified by U.S. Pat. No. 5,403,236 to Greig, and U.S. Pat. 5,281,799 to McIntire, et al., exhibits several undesirable characteristics. One is that the card has a tendency to predispense in modern printers. In addition, the card is only partially duplexible since the tape covers at least a portion of the bottom surface of the card.

Also, the tape used in creating this type of product is usually single liner transfer tape which, as is well known in the art, has a slick or smooth release liner on its bottom surface so that it can be wound upon itself and conveniently stored prior to use. When unrolled and applied to the bottom surface of the form, the tape's slick release liner is exposed. This creates a slippery area on the bottom of the form which can cause the form to feed incorrectly in printers and to slide when the forms are stacked for storage.

In the third type, a well or depression is created in a business form and the card is adhesively secured within the well as shown in U.S. Pat. No. 5,413,830 to Edwards. This card cannot be duplex printed across its entire back surface once placed in the well since its bottom surface is covered by at least a portion of the form itself.

The fourth type is known as a "clean-release" card and form combination. As exemplified by U.S. Pat. No. 5,466,013 to Casagrande, these are created by laminating a patch of material containing some combination of film layers, pressure sensitive adhesive layers and dry, splittable adhesive or varnish to the bottom surface of a business form. The card is then created out of part of the form itself by die-cutting through the top surface of the business form and to but not through the splittable adhesive or varnish. The card can then be pulled from the business form, splitting the dry adhesive or varnish and leaving a "clean" or non-sticky release surface on the card and the business form. Also, this type of card is clean-cut or die-cut from the card in form combination instead of perforated or punched-out like in the present invention.

This product carries the obvious disadvantage that the card is made from the same stock as the business form. This means that if the end user desires a card with high durability, the entire form must be made of durable material, usually plastic, which is extremely expensive and impractical given its weight, thickness and cost. On the other hand, to lower costs and make printing more practical, a lighter material must be used for the form, which lowers the durability of the card. Another disadvantage is that since this product requires a backer sheet as the bottom layer of the patch lamination in order to support the card once it is cut from the form, the card cannot be duplex printed. Moreover, due to the many layers of adhesive, film and backer, these products tend to be quite thick which can impede their passage through modern high speed printing machines. Finally, since the card is held to the backer only by adhesive, these die cut cards also predispense as the form is bent around tight radius turns in printing machines.

SUMMARY OF THE INVENTION

As outlined above, the invention provides a thin and durable business form and removable card combination which can be easily and conveniently printed upon on both its top and bottom surfaces. The principal aspect of the invention is a card-in-form combination comprising a business form with laser compatible punch-out card disposed therein. This combination comprises a business form layer containing a die cut hole slightly larger than the size of the card. The card is positioned within the hole in the form and the bottom surface of the card is permanently secured to a backer layer. The backer layer, which is slightly larger than the hole in the form, is also adhesively secured to the bottom surface of the form around the periphery of the hole. The backer layer is perforated around the edges of the card so that the card and corresponding portion of the backer layer secured to the card can be punched out and removed from the combination. In other words, part of the backer layer becomes part of the card when it is removed from the card-in-form combination.

As described herein, the present card in form combination is extremely thin. By placing the card in a hole in the form, the effective thickness of the card is reduced and the cumulative thickness problem of the previous card-on-form products is completely avoided. In addition, the backer layer, as will be discussed, is preferably a very thin material such as polyester which adds little to the overall thickness of the card-in-form combination especially since the only other layer in this laminate is a single adhesive layer.

By creating the card from plastic stock and not from paper stock, the present invention allows for just the card to be made from the more durable stock. This is also much more economical and allows the user many more choices of card and form material than some of the products disclosed in the prior art.

Also in the present invention, both sides of the card-in-form combination are capable of being printed out to all edges of the form and the card. This is due to the backer layer actually becoming part of the card when it is punched out of the form.

Unlike the prior products, the present invention will not predispense the card when bent through a tight radius because the card structurally is held within the form by the perforated backer layer and not just by releasable adhesive. Thus, the present invention may be fed through a larger variety of printing machines faster and more reliably without causing expensive and time consuming jams. And since the perforations can go only through the extremely thin backer layer and not the card itself, rough edges on the punched out card, if any, are barely perceptible.

In this way, the principal aspect of the invention advances the state of the art and meets its goals while providing structural and functional advantages over the prior art.

Another aspect of the invention relates to the card laminate used to produce the card-in-form combination. The bottom layer of the card laminate is the backer layer. The top layer of the card laminate is the card material layer with a layer of patterned release material disposed on its bottom surface. A layer of pressure sensitive adhesive laminates the bottom surface of the card material layer with the release material to the top surface of the backer stock.

The card may be formed in the card material layer by die cutting through the card material layer and to, but not through, the backer layer and by perforating a substantially corresponding line through the backer layer. Thus, the card is defined by the area of card material, adhesive and backer material within the card die cut and perforations. The patterned release material layer is generally disposed between the card material layer and backer layer such that there is little or no release material between the card material and the backer layer within the die-cut/perforated area. In this way, the die cut area of the card material is permanently adhered to the corresponding area of the perforated backer layer. And since there is no exposed adhesive in the card laminate when it is in this form, a web of card laminate can be rolled and stored until ready for use—without the use of slick release liners inherent in the transfer tapes used in the prior art.

Another aspect of the present invention is the use of an optional card border area. The border is an area of material left around the die-cut area of the card. This border is an area of card material between the card die cut and a concentric border die cut surrounding the card die cut. Like the bottom surface of the card material within the card cut, the bottom surface of the border area is not coated with release material. In this way, if the release material bleeds from its original position outside of the border cut, it will bleed into the border area and not disturb the permanent bond between the card material within the card cut and the corresponding area of backer layer.

Another aspect of the invention is the process of making the card-in-form combination using the card laminate. The slit-over-perforation method may be used in the production of the card laminate and the card-in-form combination to simultaneously die cut the card in the card material and perforate the backer material of the assembled card laminate. The use of the slit-over-perforation process with the patterned release material layer allows for the portion of the card material layer which is outside of the card die-cut (the "waste matrix") to be removed from the card laminate. This leaves die cut cards surrounded by a portion of the backer layer with exposed adhesive on its top surface. Of course, if the optional border is used, the waste matrix is that portion of the card material which is outside of the border die cut rather than the card die cut. Once the waste matrix is removed, the backer layer, if in web form, can be cut into patches and applied to the bottom surface of the business forms with the cards (or the cards plus surrounding borders) disposed in the holes in the forms. Thus, the use of the card laminate allows for the rapid and efficient manufacture of the card-in-form product.

DESCRIPTION OF THE DRAWINGS

The invention is described in conjunction with the accompanying drawings, in which.

DESCRIPTION OF THE PREFERRED EMBODIMENT

Note that the terms die cut and perforate as used in this specification include all equivalent suitable operations known in the art including slit-over-perforation operations. Moreover, perforation specifically includes all suitable methods of creating cuts and ties and other frangible connections in a layer. Also, it must be pointed out that the various stocks and layers of the present invention in all its aspects are interchangeably referred to as material, sheets, webs, lamina, or layers simply for the sake of convenience since the present invention can be constructed using either continuous webs, individual sheets, coatings, or any combination thereof. Additionally, assembly of the invention described below may or may not include the use of additional elements to ensure accurate and consistent registration of the layers. Such elements may include, but are not limited to timing marks, pinfeed layers, printing marks, and any other system or element known or discovered in the art which aids in establishing the accurate registration of the layers.

Reference is made herein to printing, as well as imaging and printing equipment. These terms refer to all forms of indicia and all equipment necessary for placing indicia onto a substrate including, but not limited to, handwriting, laser printing, offset printing, xerographic printing, etc. Moreover, it will be understood that while many of the layers described herein are capable of receiving printing thereon, the business form of the present invention may be constructed of layers devoid of indicia such that printing may be applied at a later time, for example, by the end user.

Figure 1:
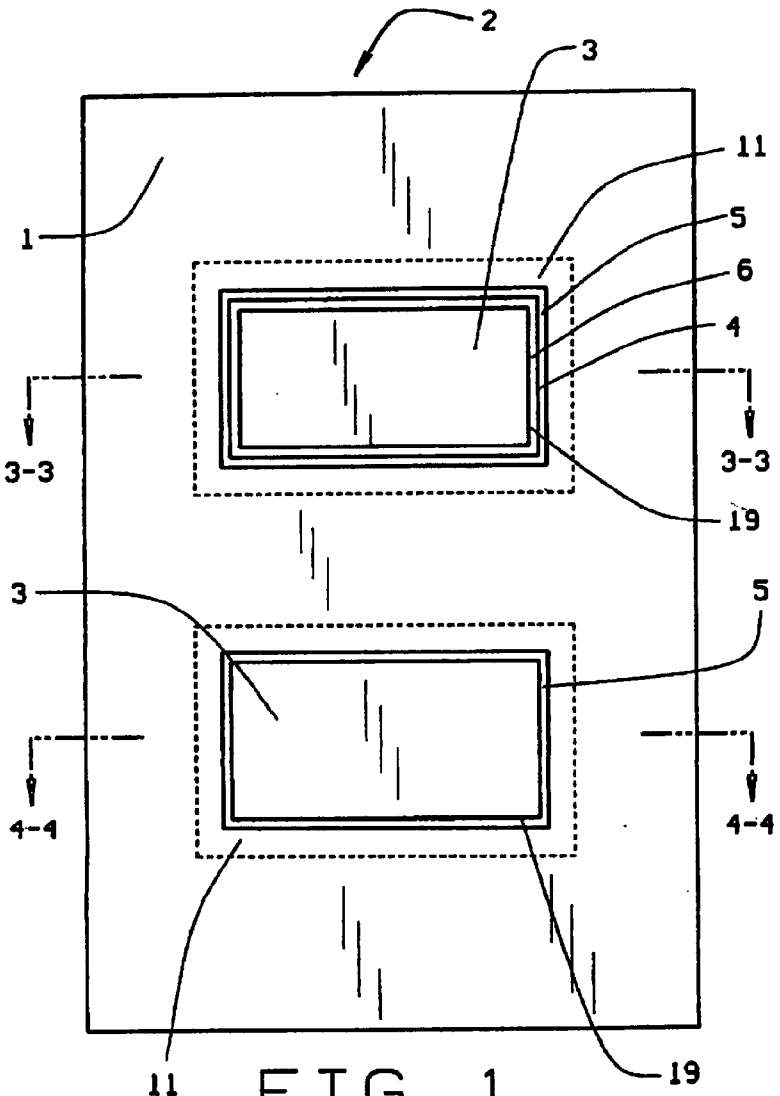
FIG. 1 is a view of the front surface of the card-in-form combination.

FIG. 1 shows the front view of the preferred embodiment of the principal aspect of the invention, a business form with at least one punch-out card, generally designated 2. The form 1, to which the card 3 attaches by the backer layer 11, can be made from nearly any paper, synthetic or laminated stock and may contain indicia on its front or back surface. Selection of the appropriate form stock is controlled primarily by the limitations of the machines used to process the stock and to print indicia on either or both sides of the form 1 and/or card 3. Appropriate stock appears to be in the approximate range of 1 mil to 20 mils. In the preferred embodiment, however, the form 1 is paper stock of between approximately 18 and 32 pounds weight with a thickness of between 3 and 6 mils. This provides the form 1 with the substance needed to pass through the high speed production and printing machines used to manufacture the card-in-form combination 2 while maximizing cost and weight considerations. For example, the distance 8 shown in FIG. 3 may be sought to be minimized or otherwise manipulated for various applications partly through the use of form 1 layers of differing thicknesses.

Also shown in FIG. 1 is the card 3 within a hole 5 in the form 1. Note that while two rectangular cards 3 and holes 5 are shown in FIG. 1 for clarity, multiple cards and holes in any quantity, shape or arrangement can be placed in a form 1. Also, although the hole 5 is shown to be completely surrounded on all sides by a portion of the form 1, the hole 5 could be place on one or more edges of the form 1 such that the hole 5 would be surrounded by a portion of form 1 on less than all sides.

Figure 3:
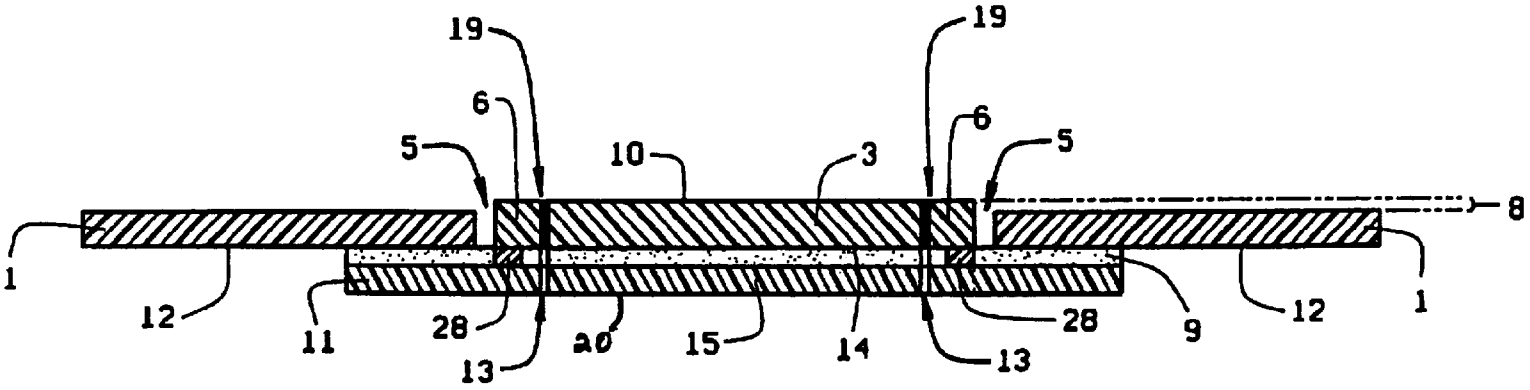
FIG. 3 is a view of the cross section of the card-in-form combination along the line 3—3 identified in FIG. 1.
Figure 4:
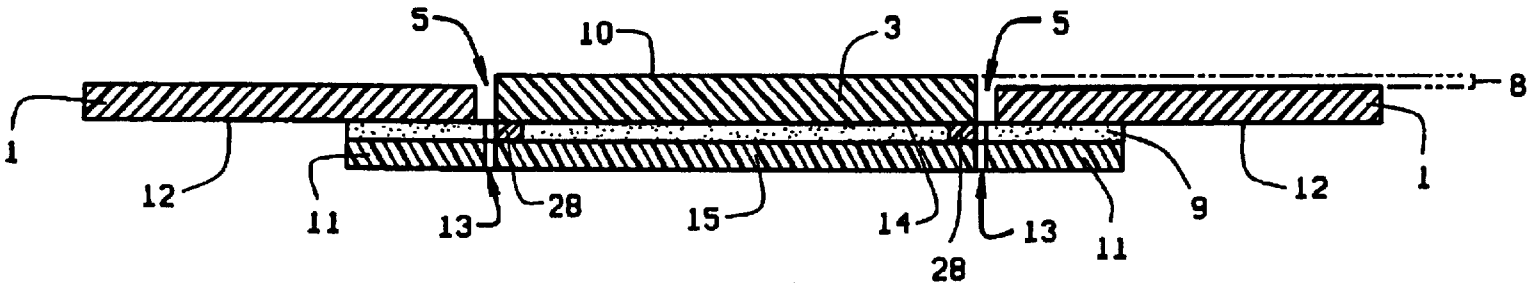
FIG. 4 is a view of the cross section of card-in-form combinations along the line 4—4 identified in FIG. 1.

Also shown in FIG. 1 is a card 3 with the optional border area 6. The border area 6 is composed of the card material 17 and is defined as the card material outside of the card cut 19 and within the border cut 4. As will be explained below, when the optional border 6 is used, the release material 23 is patterned so as to leave little or no release material within the area outlined by the border cut 4 and, therefore, the card cut 19. Thus, if the release material 23 bleeds past the border cut 4, as shown by reference 28 in FIG. 7, it probably will not bleed past the card cut 19, ensuring a relatively permanent bond between the card 3 and the backer 15. The hole 5 in the form is slightly larger than the periphery of the card 3 or the border 6, if used, so as to enable the card 3 or card 3 and border 6, if used, to be placed within the boundaries of the hole 5. FIGS. 3 and 4 shown cross sections of the card-in-form combination 2 with and without the optional border area 6.

Figure 5:
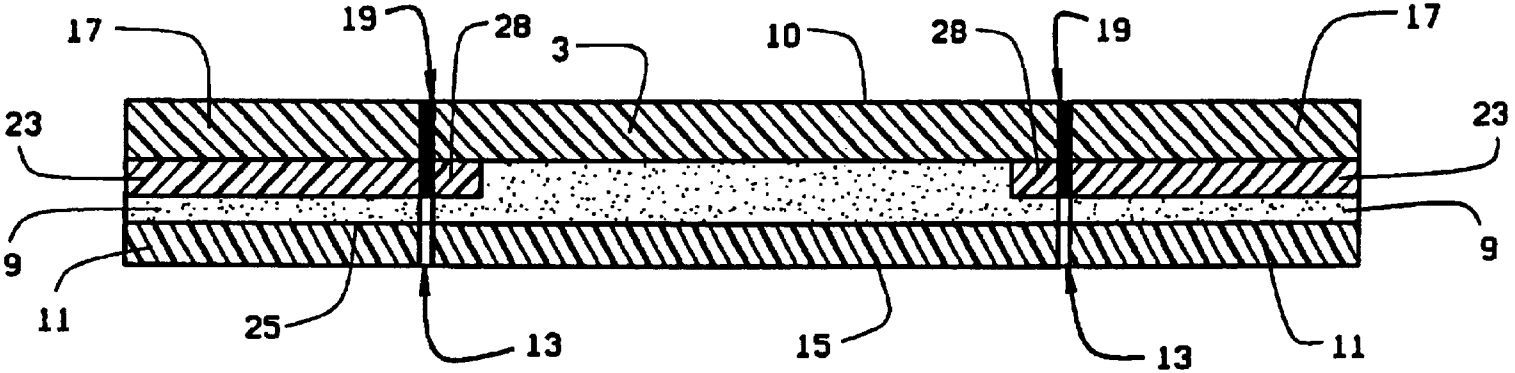
FIG. 5 is a cross section of a web of card laminate along the line 5—5 identified in FIG. 2.

The card 3 is actually formed from the card material 17 as shown in FIG. 5, a cross section of the card laminate 16. The card material 17 can be any suitable paper, synthetic or laminate stock. But to achieve the goal of having a durable card 3, the card material 17 should be strong enough to withstand the abuses of its intended use. In addition, to ensure that the card-in-form combination 2 will be printable, the card should have a printable top surface, shown as reference 10 in FIG. 3.

FIG. 1 also shows, as reference 11 generally, the area of the backer surrounding the card 3. The backer 11 is shown in dashed lines in FIG. 1 to indicate that it is actually hidden from this front view of the card-in-form combination 2. The backer 11 is better seen in FIGS. 3 and 4, as secured by the adhesive layer 9 to the bottom surface 12 of the form 1 over the hole 5 and the bottom surface 14 of the card 3. The backer 11 can be any paper, synthetic or laminate stock. However, a portion 15 of the backer 11 becomes part of the card when the card 3 is removed from the completed card-in-form 2, so the backer 11 should be as thin as possible and able to accept printing, if desired, on its bottom surface. Moreover, if it is desirable to see the bottom surface 14 of the card 3 or indicia on the bottom surface 14, the backer 11 can be of a transparent or semi-transparent material. In the preferred embodiment, the backer 11 is approximately 0.5 to 2 mils thick polyester film which is substantially transparent and is compatible with laser and other xerographic and non-impact printers.

The backer 11 also contains perforations 13 to allow the card 3 with backer portion 15 to be removed from the completed form 2. While the perforations 13 allow the card 3 with backer portion 15 to be easily removed by the end user, they are strong enough to prevent the card 3 from predispensing from the completed card-in-form 2 in the converting equipment and/or the imaging equipment, including, for example, laser printers. Additionally, the backer 11 may have a magnetic strip integrated into or applied to its bottom surface 20.

The adhesive layer 9 holding the backer 11 to the form 1 and card 3 can be any type of adhesive suitable for laminating paper and synthetic stock, however, in the preferred embodiment, pressure sensitive adhesive is used.

Figure 2:
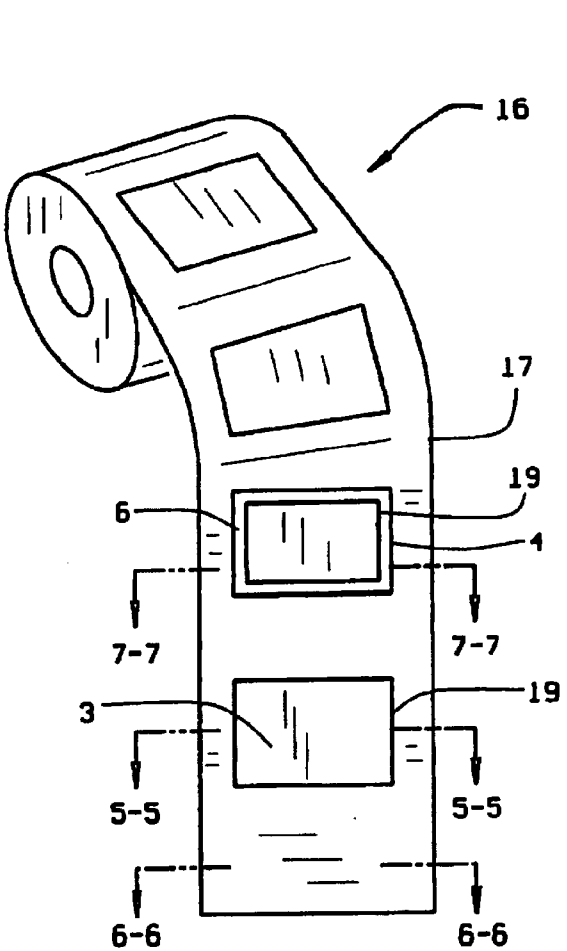
FIG. 2 is a view of a web of card laminate.
Figure 6:
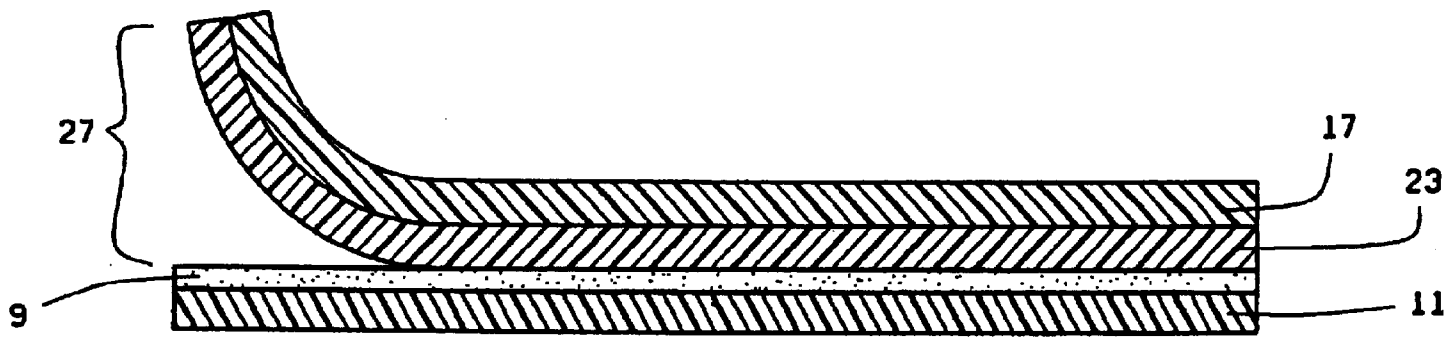
FIG. 6 is a cross section of a web of card laminate along the line 6—6 identified in FIG. 2.
Figure 7:
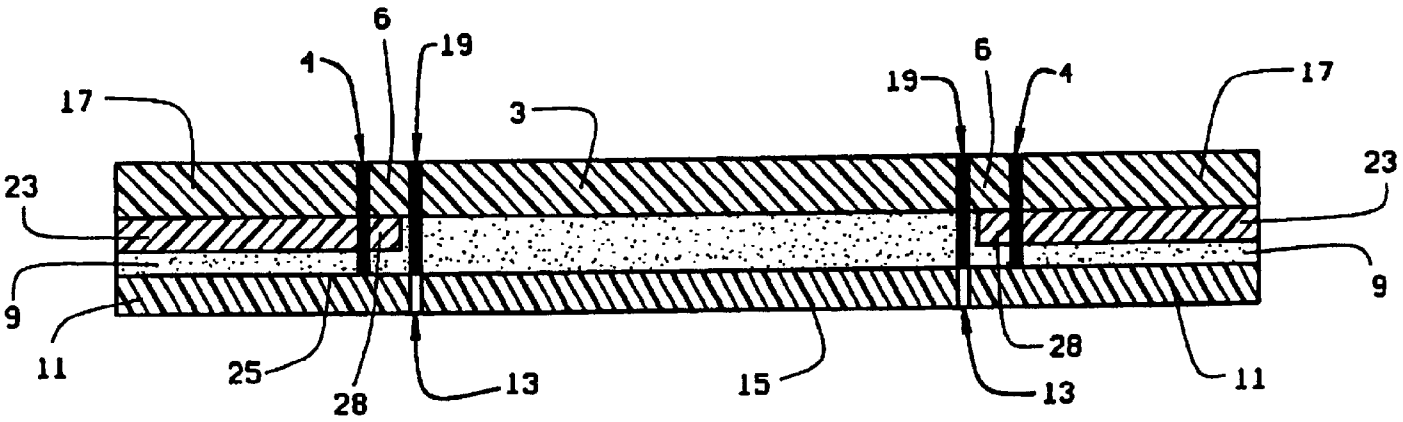
FIG. 7 is a cross section of a web of card laminate along the line 7—7 identified in FIG. 2.

FIG. 2 shows a front surface view of another aspect of the invention, a web of card laminate, shown generally as 16. The laminate 16 is constructed of essentially two layers as shown in FIGS. 5, 6 and 7. The bottom layer of the card laminate 16 is backer described above and shown as reference 11. The top layer of the card intermediate web is the previously described web of card material 17. Disposed on the bottom surface of the card material 17 is a layer of patterned release material 23.

The release material 23, shown in FIGS. 5 through 7, can be any material with a greater affinity for the card material 17 than the adhesive layer 9. In the preferred embodiment, however, the release material 23 is silicon. Unless the optional border 6 is used, the patterned release material 23 is disposed on the entire bottom surface of the card material 17 except the bottom surface 14 of the card 3. When the border 6 is used, the patterned release material 23 is disposed on the entire bottom surface of the card material 17, except that which is within the border cut 4. However, as noted above, the release material may bleed into these areas as shown by reference 28 in FIGS. 4, 5 and 7.

The card 3 is defined in the card material 17 by a die cut 19 which extends through the card stock 17 and to but not through the backer 11. The substantially corresponding area 15 of the backer sheet 11 is defined by perforations 13 in the backer 11 which approximately reference or are in registry with the line of the die-cut 19 in the card material 17. Thus, the die cut 19 and perforations 13 substantially define corresponding areas in the card stock 17 and the backer stock 11, respectively. As indicated above, there is little or no release material between the card 3 and the corresponding portion of the backer 15. Thus, the adhesive layer 9 securely bonds the card 3 and backer portion 15 together when the bottom surface of the card stock 17 with the patterned release liner 23 is laminated to the top surface 25 of the backer layer 11 as shown in FIG. 5. Similarly, where the optional border is used, there can be release material 28 between the border area 6 and the backer layer 11. When laminated, the border area 6 is, therefore, substantially secured to the backer layer 11 as shown in FIG. 3.

When the border area 6 is used, the card cut 19 can be made after the combination 2 is created or before since the only continuous cut in the card material 17 which is necessary before the combination 2 is made is the border cut 4.

Another aspect of the invention is the process of making the card laminate 16 and the process of making the card-in-form combination 2 using the card laminate 16. Production of the card laminate 16 begins by feeding a sheet or web of backer stock 11 and card stock 17 into a printing press. Patterned release material 23 is applied to the bottom surface of the card stock 17 everywhere except where the die cut card 3 will be formed in the card stock 17. Adhesive 25 is applied to the top surface of the backer 11 or the bottom surface of the card material 17 with release material 23. The bottom surface of the card material 17 and the top surface of the backer 11 are laminated together so as to be in parallel planes with each other as shown in FIGS. 5 through 7. In the preferred embodiment, the slit-over perforation method, which is well known in the industry, is used to die cut the card cut 19 in the card stock 17 and simultaneously perforate 13 the backer 11 along the same line as the die cut 19. However, any suitable operation can be used, including separate die cut and perforation steps. In addition, when the optional border area 6 is used, the border cut 4, card cut 19 and perforation 13 can be made simultaneously or in any suitable order. The card intermediate web 16 can be rolled and stored in bulk form for later use.

In use, the card laminate 16 is unrolled and the waste matrix 27, which is that portion of the card material 17 and patterned release material 23 which is not within the card die-cut 19 (or the border cut 4, if used), is removed from the card laminate 16, leaving die cut cards 3 surrounded by a portion of backer sheet 11 with exposed adhesive 9. This removal is shown generally in FIG. 6 and FIG. 8. The removal of the waste matrix 27 is made possible by the patterned release material 23 and the card die cut 19 (or the border cut 4, if used). The die cuts free the waste matrix 27 from the card 3 and border 6, if used, both of which are secured to the backer sheet 11. The release material 23 also makes the matrix 27 easily removable from the remainder of the card laminate 16.

An alternate form of the card laminate 16 has a release material on the bottom surface 20 of the backer 11. As a result, when the waste matrix 27 is removed, the rest of the laminate can still be rolled up on itself for storage and transport. Unrolling of the laminate is still possible without damage to the layers because the exposed adhesive 9 does not adhere to bottom 20 of the backer 11 due to the presence of the release material.

Figure 8:
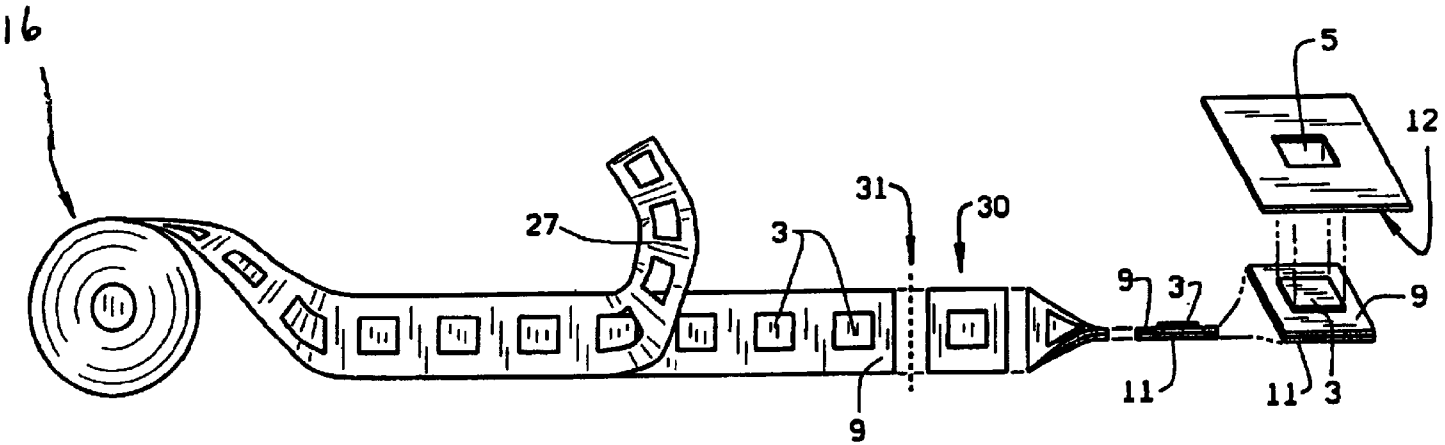
FIG. 8 is a view of a process to produce the card-in-form combination.

As shown in FIG. 8, thereafter, the backer sheet 11 without the waste matrix 27 is cut 31 into patches or "slugs" 30 and applied by vacuum transfer or other known methods to the bottom surface 12 of the business form 1 with the card 3 placed in the hole 5. Of course, if the border option is used, the card 3 and surrounding border area 6 are placed within the hole 5 as shown in FIG. 1. Thus, the use of the card laminate 16 allows for the rapid and efficient manufacture of the card-in-form product 2. Note that the card laminate 16 may be wound as shown in FIG. 8 and may contain multiple cards 3 in varying arrays of multiple rows and/or series. In use, such rolls may be split and used as single series webs as in FIG. 8 or in other configurations as appropriate for the particular production equipment used.

Figure 9:
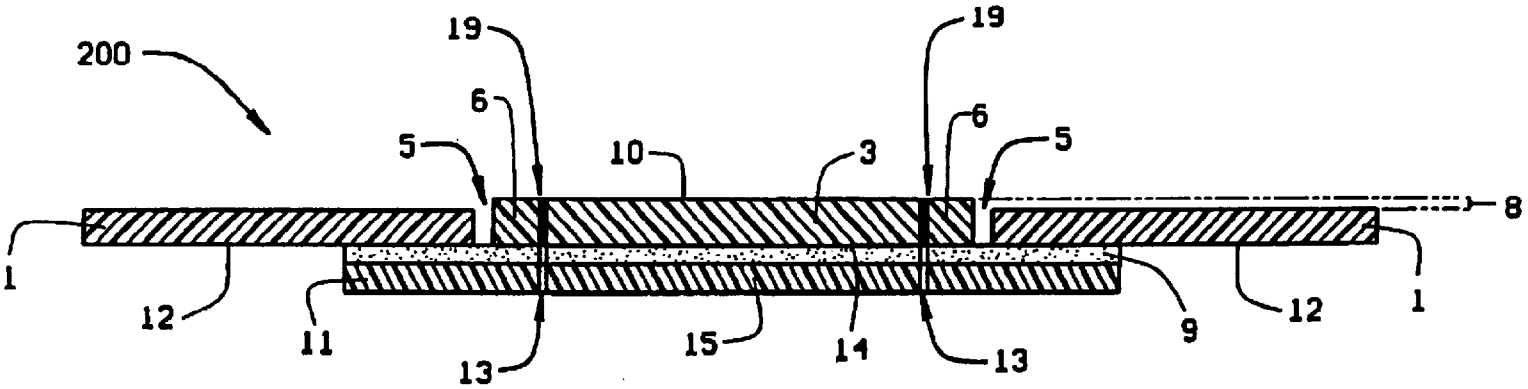
FIG. 9 is a cross section of a web of card laminate of alternate construction.

In an alternative method for creation of the card-in-form product 200 shown in FIG. 9, a hole 5 is formed in the form 1. Adhesive 9 is applied to entire top surface 25 of the backer 11 and a patch of backer 11 is laminated to the bottom 12 of form 1 over the hole 5. This results in adhesive 9 being exposed through the hole 5. A pre-made card 3 is then placed within the hole 5 in the form 1 and secured to the backer 11 by the exposed adhesive. As shown in FIG. 9, the card-in-form product of this creation method completely lacks the bled release material 28 which may be present in the other embodiments. Thus, adhesive layer 9 is substantially continuous. Unlike in the previous embodiments where the border 6 was used to protect card/backer seal from bled release material 28, the combination 200 does not have that same need. Instead, the cut 19 and perforations 13 may be used to assure accurate alignment of the card 3 with the backer portion 15 through reference or timing marks printed on the border 6. In this way, the somewhat difficult process of perforating around the perimeter of the card 3 (described below) is avoided.

Figure 10:
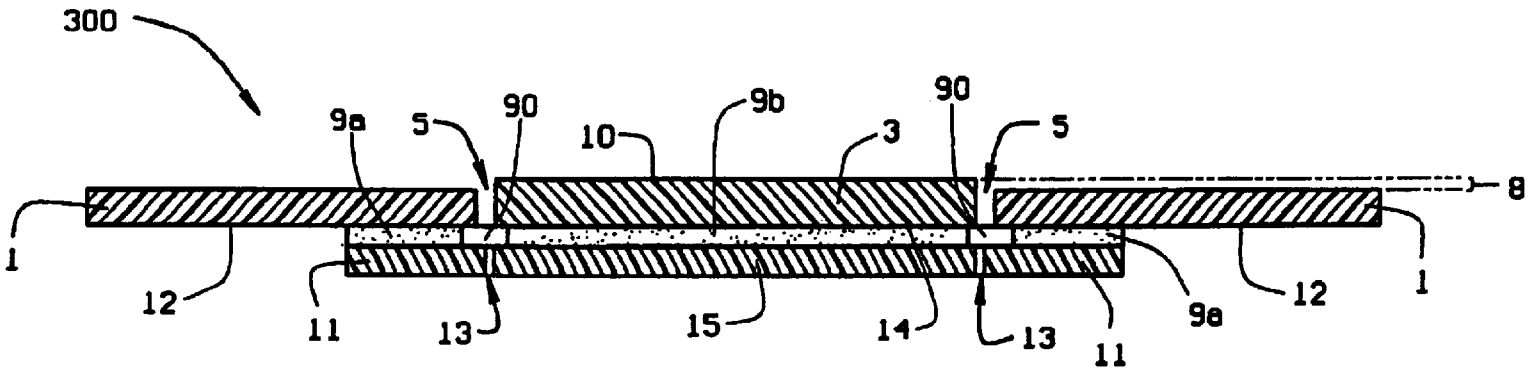
FIG. 10 is a cross section of an alternate card in form combination.

Alternatively, and as illustrated in FIG. 10, the backer 11 may be secured to bottom 12 of the form 1 with an adhesive layer 9*a* which extends around the perimeter of the hole 5. In this way, adhesive 9 is not exposed through the hole 5 prior to the placement of the card 3 within the hole 5. Instead, the adhesive 9*b* is placed on the bottom 14 of the card 3 prior to its placement in the hole 5. This method may result in a gap 90 between the adhesive 9*a* and 9*b*. The lack of exposed adhesive in the hole 5 may allow greater compatibility with certain production machines.

As an alternative to placing the adhesive on the bottom of the card 3, it may be placed onto the top of the backer 11 through the hole 5. In this way, the adhesive may be patterned on the backer 11 such that no adhesive is placed in the gap that may exist between the card and the edges of the hole 5.

Both the border and non-border options are possible with either of these two alternative methods of construction. For example, FIG. 9 shows the card-in-form combination 200 created by placing the backer with full adhesive layer 9 over the hole 5 and placing the card 3 within the hole 5. It also shows the use of the border 6 created by the die cut 19 and the perforation 13. FIG. 10 shows the non-border option created by having the backer 11 perforated around the perimeter of the card 3 so that the card 3 and backer portion 15 can be punched-out and removed from the card-in-form combination 2. The pre-made card 3 may be cut from continuous rolls of card material 17 or affixed as unit pieces.

Figure 11:
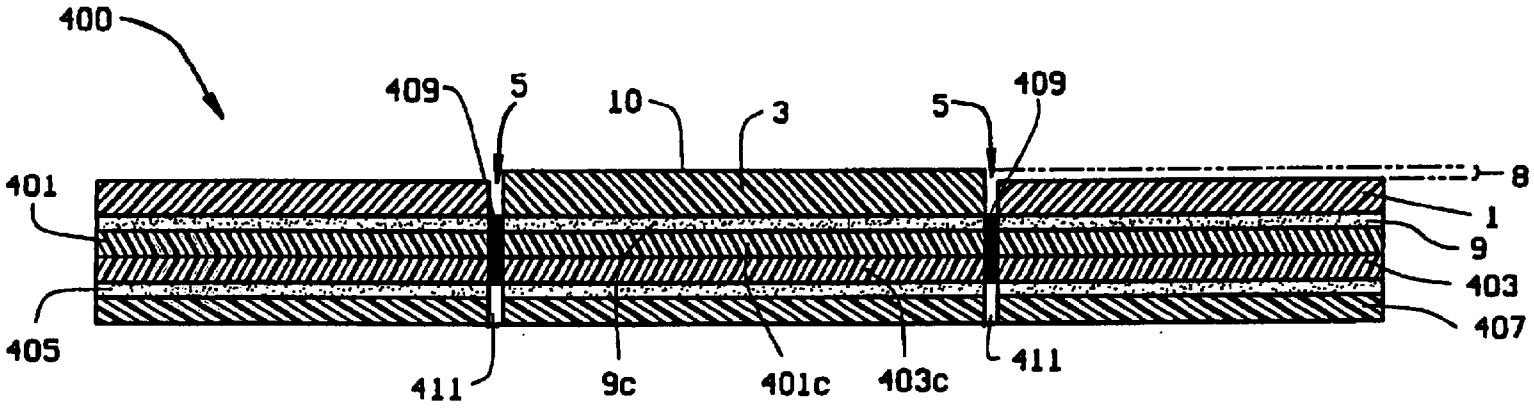
FIG. 11 is a cross section of an alternate card in form combination adapted to create a card with at least translucent coverings on both sides.
Figure 12:
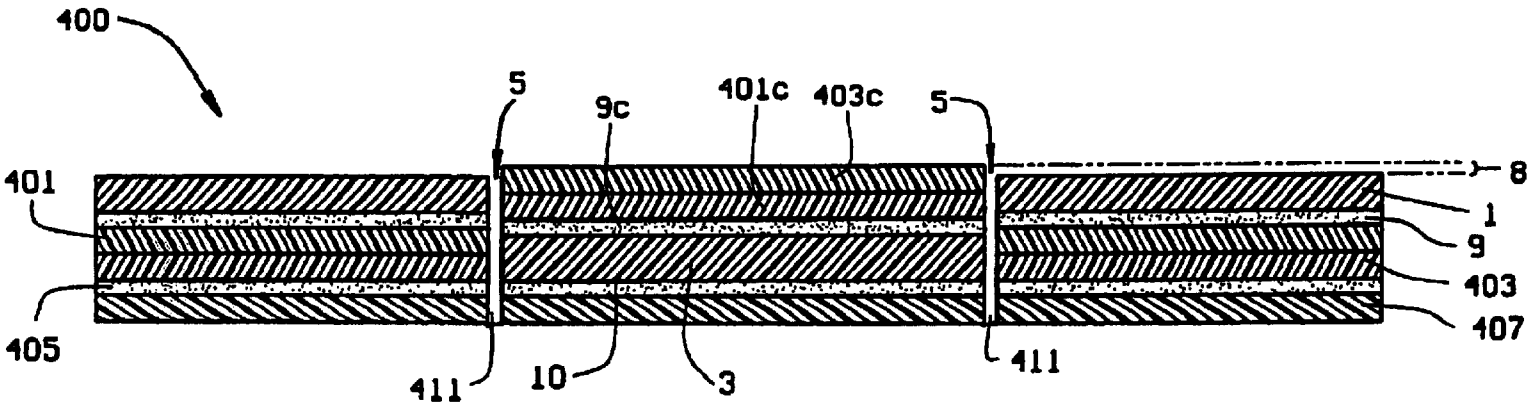
FIG. 12 is a cross section of the web of FIG. 11 showing the card laminate in use.

Another alternative card-in-form combination of the present invention allows for the production of a card that has additional layers on both sides when it is removed from the form. As shown in cross section in FIG. 11, the card-in-form combination 400, includes the form 1, the card 3, and the adhesive layer 9. On the bottom of the adhesive layer is a first layer of at least translucent and preferably transparent material 401, followed by a layer of release material 403, a second adhesive layer 405 and a second at least translucent layer 407. Die cuts 409 substantially conforming to the perimeter of the card 3 (when the non-border option is exercised) first translucent layer 401 as well as the release layer 403. In this way the card 3, in combination with those portions of the adhesive layer 9*c*, the first translucent layer 401*c*, and the release layer 403*c* within the die cuts 409 may be removed from the combination 400 exposing the second adhesive layer 405 within the hole 5. The card combination of 3, 9*c*, th 401*c* and 403*c* is then inverted and placed back into the hole 5 adhering the top surface 10 of the card 3 to the second translucent layer 407 by the second adhesive layer 405. As above, perforations 411 allow the card 3 to be removed from the card-in-form combination 400 for use.

As will be understood, the alternative construction methods as described above may be employed with this alternative, including the border and slit-over-perf operations. Moreover, as additional information, including support for the above alternative as well as variations thereof, applicant incorporates by reference the entire pending U.S. application Ser. No. 09/144,132 filed by applicant on Aug. 31, 1998 for a Self-Laminating Integrated Card and Method. Said application discloses and claims an invention for production of a lamination which may be used to produce cards with additional layers on both sides. As such, the elements and techniques of the Ser. No. 09/144,132 application may be applied to yield alternatives to the primary embodiment of the present invention. Such alternatives are expressly included herein.

Figure 13:
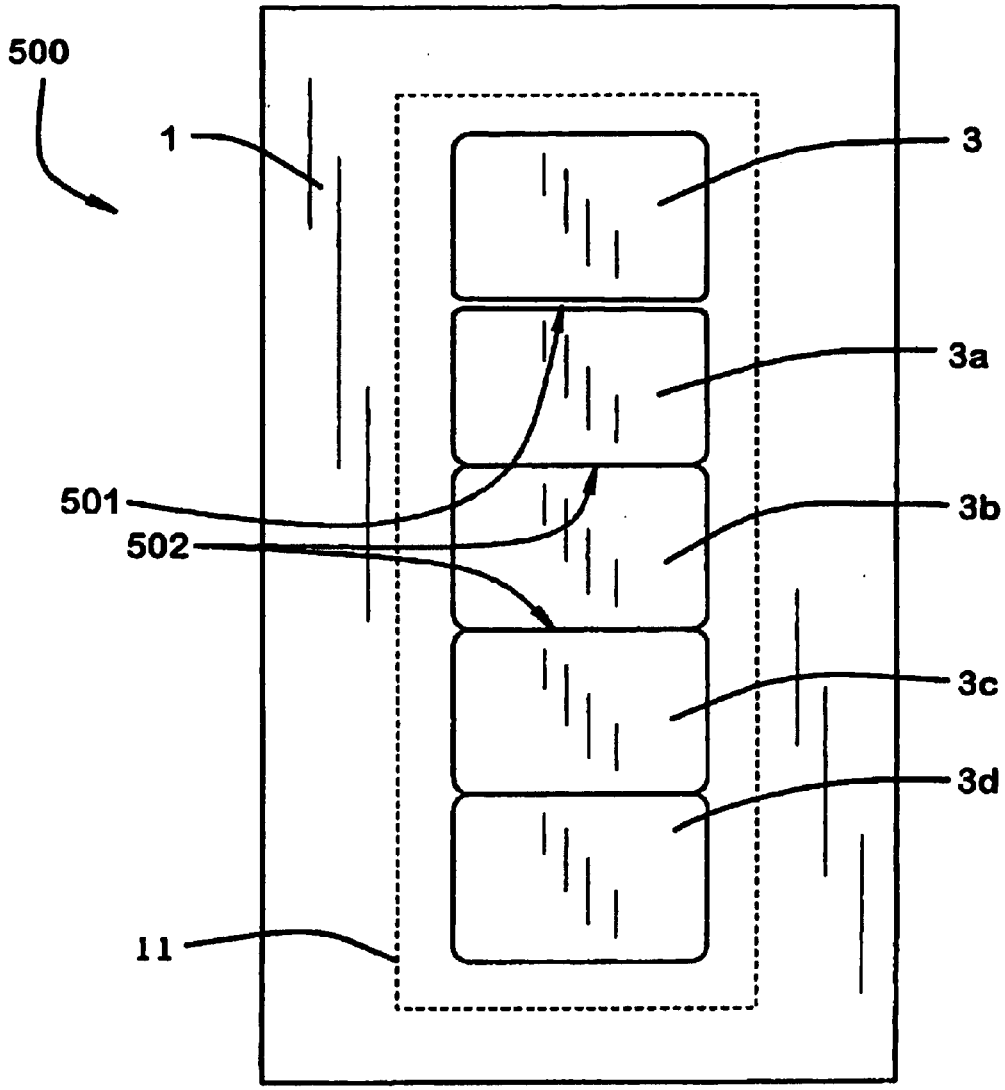
FIG. 13 is a plan view of a multifold alternate form of the invention.

Another alternative construction for the above embodiments involves the creation of multifold card-in-form combinations, generally 500 in FIG. 13. As shown in FIG. 13, card 3 is constructed as previously described. Form cards 3*a* through 3*d*, however, are simply cards die cut from the form layer 1 and retained in the combination 500 by the presence of the backer 11 as described above. As will be understood, the connection 501 between card 3 and Form card 3*b* is solely by the backer 11 and which contain a line of perforations between the card 3 and form card 3*b*. The connections 502 between the form cards, 3*b* through 3*d* may be a fold line or a line of perforations, the later of which would allow for the convenience separation of the cards as desired.

It will be apparent to those skilled in the art that numerous variations may be made to this invention within the scope of this disclosure, therefore, this scope is to be given the broadest interpretation allowed under the law to encompass all equivalent structures and methods without limitation.

I claim:

1. A business form with card comprising:

a planar form layer having top and bottom surfaces and a hole having an area through the top and bottom surfaces, the hole being bordered by a continuous cut through the form layer;

a planar card having top and bottom surfaces, the card being disposed within the hole bordered by the continuous cut through the form layer, parallel to the planar form layer;

a planar layer of backer having an area at least slightly larger than the area of the hole and being permanently and adhesively secured to the bottom surface of the planar card and secured to the bottom surface of the planar form layer over the hole.

2. The business form with card of claim 1 wherein the planar layer of backer contains perforations within the planar layer of backer between an area of the planar layer of backer secured to the bottom surface of the planar form layer and an area of the planar layer of backer secured to the bottom surface of the card such that the planar card and a portion of the planar layer of backer secured to the planar card can be removed from the business form with card by breaking the perforations.

3. The business form with card of claim 1, further comprising:

the planar form layer having a peripheral edge and the planar layer of backer having a peripheral edge that is inside and spaced from the planar form layer peripheral edge.

4. A business form with card comprising:

a planar form layer having top and bottom surfaces and a hole having an area through the top and bottom surfaces, the hole being bordered by a continuous cut through the form layer;

a planar card having top and bottom surfaces, the planar card being disposed within the hole bordered by the continuous cut through the form layer, parallel to the planar form layer;

a planar layer of backer having an area at least slightly larger than the area of the hole and being secured to the bottom surface of the planar card and the bottom surface of the planar form layer over the hole, the planar layer of backer containing perforations within the planar layer of backer between the area of the planar layer of backer secured to the bottom surface of the planar form layer and the area of the planar layer of backer secured to the bottom surface of the card such that the planar card and the portion of the planar layer of backer secured to the planar card can be removed from the business form with card by breaking the perforations.

5. The business form with card of claim 4, further comprising:

the planar form layer having a peripheral edge and the planar layer of backer having a peripheral edge that is inside and spaced from the planar form layer peripheral edge.

6. A business form with card comprising:

a planar form layer having top and bottom surfaces and a hole having an area through the top and bottom surfaces;

a planar card having top and bottom surfaces, disposed within the hole, parallel to the planar form layer;

a planar layer of backer having an area at least slightly larger than the area of the hole, and being secured to the bottom surface of the planar card and the bottom surface of the planar form layer over the hole;

a planar border having top and bottom surfaces and a periphery, said planar border being defined as an area of material co-planar with the planar card, disposed around the periphery of the planar card and separated from the planar card;

wherein the planar border is parallel to the planar card and the planar layer of backer, and the bottom surface of the border is secured to the planar layer of backer;

wherein the planar card and the planar border are disposed within the hole in the business form.

7. The business form with card of claim 6 wherein the planar layer of backer is permanently and adhesively secured to the bottom surface of the planar card, the bottom surface of the planar border and the bottom surface of the planar form layer.

8. The business form with card of claim 6 wherein the planar layer of backer contains perforations within the backer between the area of backer secured to the bottom surface of the planar border area and the area of the planar layer of backer secured to the bottom surface of the card such that the planar card and the portion of the planar layer of backer secured to the planar card can be removed from the business form with card by breaking the perforations.

9. The business form with card of claim 7 wherein the planar layer of backer contains perforations within the planar layer of backer between the area of backer secured to the bottom surface of the planar border area and the area of the planar layer of backer secured to the bottom surface of the planar card such that the card and the portion of the planar layer of backer secured to the planar card can be removed from the business form with card by breaking the perforations.

10. A method of making a business form with card comprising the steps of:

creating a hole with an area in a form layer having top and bottom surfaces by cutting a continuous cut through the form layer where the continuous cut borders the hole;

applying permanent adhesive to a patch of continuous backer layer having top and bottom surfaces and an area larger than the area of the hole bordered by the continuous cut, said permanent adhesive being disposed on the top surface of the backer;

securing the continuous backer layer to the bottom surface of the form over the hole bordered by the continuous cut with the permanent adhesive, thereby exposing the permanent adhesive through the hole bordered by the continuous cut from the top surface of the form;

securing a card to the continuous backer layer by the exposed permanent adhesive through the hole bordered by the continuous cut in the form.

11. The method of claim 10, further comprising:

securing the card to the continuous backer layer prior to securing the continuous backer layer to the bottom surface of the form.

12. The method of claim 10, further comprising the step of creating perforations within the continuous backer layer between the area of the continuous backer layer secured to the bottom surface of the form layer and the area of the continuous backer layer secured to the bottom surface of the card.

13. The method of claim 12, further comprising:

creating the perforations within the continuous backer layer prior to securing the continuous backer layer to the bottom surface of the form.

14. A card laminate comprising:

a layer of card material;

a layer of backer material;

a layer of adhesive between the layer of card material and the layer of backer material, the layer of adhesive securing the layer of card material to the layer of backer material;

a continuous cut through the layer of card material, the continuous cut defining a card in the card material that is bordered by the continuous cut; and, perforations cut through the layer of backer material, the perforations being coincident with the continuous cut through the layer of card material.

15. The card laminate of claim 14, further comprising:

the continuous cut in the layer of card material being cut through only the layer of card material; and, perforations cut through the layer of backer material also being cut through the layer of adhesive.

16. The card laminate of claim 14, further comprising:

the continuous cut in the layer of card material having a rectangular configuration that gives the card formed by the continuous cut a rectangular configuration; and, the perforations in the layer of backer material having a rectangular configuration that coincides with the rectangular configuration of the continuous cut.

17. A card laminate comprising:

a layer of card material;

a layer of backer material;

a layer of adhesive between the layer of card material and the layer of backer material, the layer of adhesive securing the layer of card material to the layer of backer material;

a continuous cut through the layer of card material, the continuous cut defining a card in the card material that is bordered by the continuous cut;

perforations cut through the layer of backer material, the perforations being coincident with the continuous cut through the layer of card material;

the layer of adhesive between the layer of card material and the layer of backer material being a permanent adhesive; and, a layer of releasable adhesive between the layer of permanent adhesive and the layer of card material but not between the layer of permanent adhesive and the card.

18. A method of making a business form with a card comprising the steps of:

providing a card laminate comprising a backer material layer, an adhesive material layer, and a card material layer secured to the backer material layer by the adhesive material layer;

cutting through the card material layer and stopping short of the backer material layer creating a card of the card material and a waste matrix of the card material;

removing the waste matrix from the card laminate exposing a portion of the adhesive material layer;

providing a form layer with opposite top and bottom surfaces and a hole through the form layer top and bottom surfaces; and, securing the portion of the adhesive material layer to the form layer bottom surface with the card of the card material positioned in the hole through the form layer top and bottom surfaces.

19. The method of claim 18, further comprising:

providing perforations through the backer material layer around the card of card material.

20. The method of claim 18, further comprising:

providing perforations through the backer material layer simultaneously with cutting through the card material layer.

21. The method of claim 18, further comprising:

cutting through the card material layer and stopping short of the backer material layer around the card of card material creating a border of the card material around the card of card material.

22. A method of making a business form with a card comprising the steps of:

providing a card laminate comprising a backer material layer, and adhesive material layer, and a card material layer secured to the backer material layer by the adhesive material layer;

cutting through the card material layer and stopping short of the backer material layer creating a card of the card material and a wasted matrix of the card material;

removing the waste matrix from the card laminate exposing a portion of the adhesive material layer;

providing a form layer with opposite top and bottom surfaces and a hole through the form layer top and bottom surfaces;

securing the portion of the adhesive material layer to the form layer bottom surface with the card of the card material positioned in the hole through the form layer top and bottom surfaces; and, providing a permanent adhesive as the card laminate adhesive layer.

23. The method of claim 22, further comprising:

providing the card laminate with a releasable adhesive layer between the permanent adhesive layer and the waste matrix of card material and not between the permanent adhesive layer and the card of card material.

* * * * *